US007873510B2

(12) United States Patent
Kurniawati et al.

(10) Patent No.: US 7,873,510 B2
(45) Date of Patent: Jan. 18, 2011

(54) ADAPTIVE RATE CONTROL ALGORITHM FOR LOW COMPLEXITY AAC ENCODING

(75) Inventors: Evelyn Kurniawati, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 931 days.

(21) Appl. No.: 11/796,036

(22) Filed: Apr. 26, 2007

(65) Prior Publication Data

US 2007/0255562 A1 Nov. 1, 2007

(30) Foreign Application Priority Data

Apr. 28, 2006 (SG) ..... 200602922-7

(51) Int. Cl.
*G10L 19/00* (2006.01)

(52) U.S. Cl. ..... 704/200.1

(58) Field of Classification Search ..... 704/200.1
See application file for complete search history.

(56) References Cited

U.S. PATENT DOCUMENTS 7,523,039 B2 * 4/2009 Manu ..... 704/501

OTHER PUBLICATIONS

E. Kurniawati et al., "New Implementation Techniques of an Efficient MPEG Advanced Audio Coder," 2004 IEEE, pp. 655-665.

* cited by examiner

*Primary Examiner*—Susan McFadden
(74) *Attorney, Agent, or Firm*—Lisa K. Jorgenson; William A. Munck

(57) ABSTRACT

A system and method for adaptive rate control in audio processing is provided. The process could include receiving uncompressed audio data from an input and generating MDCT spectrum for each frame of the uncompressed audio data using a filterbank. The process could also include estimating masking thresholds for current frame to be encoded based on the MDCT spectrum. The masking thresholds reflect a bit budget for the current frame. The process could also include performing quantization of the current frame based on the masking thresholds. After the quantization of the current frame, the bit budget for next frame is updated for estimating the masking thresholds of the next frame. The process could also include encoding the quantized audio data.

35 Claims, 9 Drawing Sheets

ADAPTIVE RATE CONTROL ALGORITHM FOR LOW COMPLEXITY AAC ENCODING

CROSS-REFERENCE TO RELATED APPLICATIONS

The present application is related to Singapore Patent Application No. 200602922-7, filed Apr. 28, 2006, entitled "ADAPTIVE RATE CONTROL ALGORITHM FOR LOW COMPLEXITY AAC ENCODING". Singapore Patent Application No. 200602922-7 is assigned to the assignee of the present application and is hereby incorporated by reference into the present disclosure as if fully set forth herein. The present application hereby claims priority under 35 U.S.C. §119(a) to Singapore Patent Application No. 200602922-7.

TECHNICAL FIELD

The present disclosure generally relates to devices and processes for encoding audio signals, and more particularly to AAC-LC encoders and associated methods applicable in the field of audio compression for transmission or storage purposes, particularly those involving low power devices.

BACKGROUND

Efficient audio coding systems are generally those that could optimally eliminate irrelevant and redundant parts of an audio stream. Conventionally, the first is achieved by reducing psychoacoustical irrelevancy through psychoacoustics analysis. The term "perceptual audio coder" was coined to refer to those compression schemes that exploit the properties of human auditory perception. Further reduction is obtained from redundancy reduction.

Conventional psychoacoustics analysis generates masking thresholds on the basis of a psychoacoustic model of human hearing and aural perception. Psychoacoustic modeling typically takes into account the frequency-dependent thresholds of human hearing and a psychoacoustic phenomenon referred to as masking, whereby a strong frequency component close to one or more weaker frequency components tends to mask the weaker components, rendering them inaudible to a human listener. This makes it possible to omit the weaker frequency components when encoding audio signal, and thereby achieve a higher degree of compression, without adversely affecting the perceived quality of the encoded audio data stream. The masking data comprises a signal-to-mask ratio value for each frequency sub-band from the filter bank. These signal-to-mask ratio values represent the amount of signal masked by the human ear in each frequency sub-band, and are therefore also referred to as masking thresholds.

There is therefore a need for improved systems and methods for encoding audio data.

SUMMARY

Other technical features may be readily apparent to one skilled in the art from the following figures, descriptions and claims.

One embodiment of the present disclosure provides a process for encoding an audio data. In this embodiment, the process comprises receiving uncompressed audio data from an input, generating MDCT spectrum for each frame of the uncompressed audio data using a filterbank, estimating masking thresholds for current frame to be encoded based on the MDCT spectrum, wherein the masking thresholds reflect a bit budget for the current frame, performing quantization of the current frame based on the masking thresholds, wherein after the quantization of the current frame, the bit budget for next frame is updated for estimating the masking thresholds of the next frame, and encoding the quantized audio data.

In another embodiment of the process, the step of generating MDCT spectrum further comprises generating MDCT spectrum using the following equation:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2$$

where $X_{i,k}$ is the MDCT coefficient at block index I and spectral index k; z is the windowed input sequence; n the sample index; k the spectral coefficient index; i the block index; and N the window length (2048 for long and 256 for short); and where $n_o$ is computed as (N/2+1)/2.

In another embodiment of the process, the step of estimating masking thresholds further comprises: calculating energy in scale factor band domain using the MDCT spectrum; performing simple triangle spreading function; calculating tonality index; performing masking threshold adjustment (weighted by variable Q); and performing comparison with threshold in quiet; thereby outputting the masking threshold for quantization.

In another further embodiment of the process, the step of performing quantization further comprises performing quantization using a non-uniform quantizer according to the following equation:

$$\text{x_quantized}(i) = int\left[\frac{x^{3/4}}{2^{\frac{3}{16}(gl-scf(i))}} + 0.4054\right]$$

where x_quantized(i) is the quantized spectral values at scale factor band index (i); i is the scale factor band index, x the spectral values within that band to be quantized, gl the global scale factor (the rate controlling parameter), and scf(i) the scale factor value (the distortion controlling parameter).

In another further embodiment of the process, the step of performing quantization further comprises searching only the scale factor values to control the distortion and not adjusting the global scale factor value, whereby the global scale factor value is taken as the first value of the scale factor (scf(0)).

In another further embodiment of the process, the step of performing masking threshold adjustment further comprises linearly adjusting variable Q using the following formula:

$$\text{New}Q = Q1 + (R1 - \text{desired_}R)(Q2 - Q1)/(R2 - R1)$$

where NewQ is basically the variable Q "after" the adjustment; Q1 and Q2 are the Q value for one and two previous frame respectively; and R1 and R2 are the number of bits used in previous and two previous frame, and desired_R is the desired number of bits used; and wherein the value (Q2−Q1)/(R1−R2) is adjusted gradient. In another further embodiment of the process, the step of performing masking threshold adjustment further comprises continuously updating the adjusted gradient based on audio data characteristics with a hard reset of the value performed in the event of block switching. In another further embodiment of the process, the step of performing masking threshold adjustment further comprises bounding and proportionally distributing the value of variable Q across three frames according to the energy content in the respective frames. In another further embodiment of the process, the step of performing masking threshold adjustment further comprises weighting the adjustment of the masking threshold to reflect better on the number of bits available for encoding by using the value of Q together with tonality index.

Another embodiment of the present disclosure provides an audio encoder for compressing uncompressed audio data. In this embodiment, the audio encoder comprises a psychoacoustics model (PAM) for estimating masking thresholds for current frame to be encoded based on a MDCT spectrum, wherein the masking thresholds reflect a bit budget for the current frame; and a quantization module for performing quantization of the current frame based on the masking thresholds, wherein after the quantization of the current frame, the bit budget for next frame is updated for estimating the masking thresholds of the next frame; whereby the PAM and quantization module are so electronically configured that the PAM estimates the masking thresholds by taking into account the bit status updated by the quantization module. In another embodiment of the audio encoder, it further comprises a means for receiving uncompressed audio data from an input; and a filter bank electronically connected to the receiving means for generating the MDCT spectrum for each frame of the uncompressed audio data; wherein the filterbank is electronically connected to the PAM so that the MDCT spectrum is outputted to the PAM. In another embodiment of the audio encoder, it further comprises an encoding module for encoding the quantized audio data. In another further embodiment of the audio encoder, the encoding module is an entropy encoding one.

In another embodiment of the audio encoder, the filter bank generates the MDCT spectrum using the following equation:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2$$

where $X_{i,k}$ is the MDCT coefficient at block index I and spectral index k; z is the windowed input sequence; n the sample index; k the spectral coefficient index; i the block index; and N the window length (2048 for long and 256 for short); and where $n_o$ is computed as (N/2+1)/2.

In another embodiment of the audio encoder, the psychoacoustics model (PAM) estimates the masking thresholds by the following operations: calculating energy in scale factor band domain using the MDCT spectrum; performing simple triangle spreading function; calculating tonality index; performing masking threshold adjustment (weighted by variable Q); and performing comparison with threshold in quiet; thereby outputting the masking threshold for quantization.

In another embodiment of the audio encoder, the step of performing quantization further comprises performing quantization using a non-uniform quantizer according to the following equation:

$$\text{x_quantized}(i) = int\left[\frac{x^{3/4}}{2^{\frac{3}{16}(gl-scf(i))}} + 0.4054\right]$$

where x_quantized(i) is the quantized spectral values at scale factor band index (i); i is the scale factor band index, x the spectral values within that band to be quantized, gl the global scale factor (the rate controlling parameter), and scf(i) the scale factor value (the distortion controlling parameter).

In another embodiment of the audio encoder, the step of performing quantization further comprises searching only the scale factor values to control distortion and not adjusting the global scale factor value, whereby the global scale factor value is taken as the first value of the scale factor (scf(0)).

In another embodiment of the audio encoder, the step of performing masking threshold adjustment further comprises linearly adjusting variable Q using the following formula:

$$\text{New}Q = Q1 + (R1 - \text{desired_}R)(Q2 - Q1)/(R2 - R1)$$

where NewQ is basically the variable Q "after" the adjustment; Q1 and Q2 are the Q value for one and two previous frame respectively; and R1 and R2 are the number of bits used in previous and two previous frame, and desired_R is the desired number of bits used; and wherein the value (Q2−Q1)/(R1−R2) is adjusted gradient. In another further embodiment of the audio encoder, the step of performing masking threshold adjustment further comprises continuously updating the adjusted gradient based on audio data characteristics with a hard reset of the value performed in the event of block switching. In another further embodiment of the audio encoder, the step of performing masking threshold adjustment further comprises bounding and proportionally distributing the value of variable Q across three frames according to the energy content in the respective frames. In another further embodiment of the encoder, the step of performing masking threshold adjustment further comprises weighting the adjustment of the masking threshold to reflect better on the number of bits available for encoding by using the value of Q together with tonality index.

Another embodiment of the present disclosure provides an electronic device that comprises an electronic circuitry capable of receiving of uncompressed audio data; a computer-readable medium embedded with an audio encoder so that the uncompressed audio data can be compressed for transmission and/or storage purposes; and an electronic circuitry capable of outputting the compressed audio data to a user of the electronic device; wherein the audio encoder comprises: a psychoacoustics model (PAM) for estimating masking thresholds for current frame to be encoded based on a MDCT spectrum, wherein the masking thresholds reflect a bit budget for the current frame; and a quantization module for performing quantization of the current frame based on the masking thresholds, wherein after the quantization of the current frame, the bit budget for next frame is updated for estimating the masking thresholds of the next frame; whereby the PAM and quantization module are so electronically configured that the PAM estimates the masking thresholds by taking into account the bit status updated by the quantization module.

In another embodiment of the electronic device, the audio encoder further comprises a means for receiving uncompressed audio data from an input; and a filter bank electronically connected to the receiving means for generating the MDCT spectrum for each frame of the uncompressed audio data; wherein the filterbank is electronically connected to the PAM so that the MDCT spectrum is outputted to the PAM. In another embodiment of the electronic device, the audio encoder further comprises an encoding module for encoding the quantized audio data. In another embodiment of the electronic device, the encoding module is an entropy encoding one.

In another embodiment of the electronic device, the filter bank generates the MDCT spectrum using the following equation:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2$$

where $X_{i,k}$ is the MDCT coefficient at block index I and spectral index k; z is the windowed input sequence; n the sample index; k the spectral coefficient index; i the block index; and N the window length (2048 for long and 256 for short); and where $n_o$ is computed as (N/2+1)/2.

In another embodiment of the electronic device, the psychoacoustics model (PAM) estimates the masking thresholds by the following operations: calculating energy in scale factor band domain using the MDCT spectrum; performing simple triangle spreading function; calculating tonality index; performing masking threshold adjustment (weighted by variable Q); and performing comparison with threshold in quiet; thereby outputting the masking threshold for quantization.

In another embodiment of the electronic device, the step of performing quantization further comprises performing quantization using a non-uniform quantizer according to the following equation:

$$\text{x_quantized}(i) = int\left[\frac{x^{3/4}}{2^{\frac{3}{16}(gl-scf(i))}} + 0.4054\right]$$

where x_quantized(i) is the quantized spectral values at scale factor band index (i); i is the scale factor band index, x the spectral values within that band to be quantized, gl the global scale factor (the rate controlling parameter), and scf(i) the scale factor value (the distortion controlling parameter).

In another embodiment of the electronic device, the step of performing quantization further comprises searching only the scale factor values to control distortion and not adjusting the global scale factor value, whereby the global scale factor value is taken as the first value of the scale factor (scf(0)).

In another embodiment of the electronic device, the step of performing masking threshold adjustment further comprises linearly adjusting variable Q using the following formula:

$$\text{New}Q = Q1 + (R1 - \text{desired_}R)(Q2 - Q1)/(R2 - R1)$$

where NewQ is basically the variable Q "after" the adjustment; Q1 and Q2 are the Q value for one and two previous frame respectively; and R1 and R2 are the number of bits used in previous and two previous frame, and desired_R is the desired number of bits used; and wherein the value (Q2−Q1)/(R1−R2) is adjusted gradient. In another further embodiment of the electronic device, the step of performing masking threshold adjustment further comprises continuously updating the adjusted gradient based on audio data characteristics with a hard reset of the value performed in the event of block switching. In another further embodiment of the electronic device, the step of performing masking threshold adjustment further comprises bounding and proportionally distributing the value of variable Q across three frames according to the energy content in the respective frames. In another further embodiment of the electronic device, the step of performing masking threshold adjustment further comprises weighting the adjustment of the masking threshold to reflect better on the number of bits available for encoding by using the value of Q together with tonality index.

In another embodiment of the electronic device, the electronic device includes audio player/recorder, PDA, pocket organizer, camera with audio recording capacity, computers, and mobile phones.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Throughout this application, where publications are referenced, the disclosures of these publications are hereby incorporated by reference, in their entireties, into this application in order to more fully describe the state of art to which this disclosure pertains.

Figure 1:
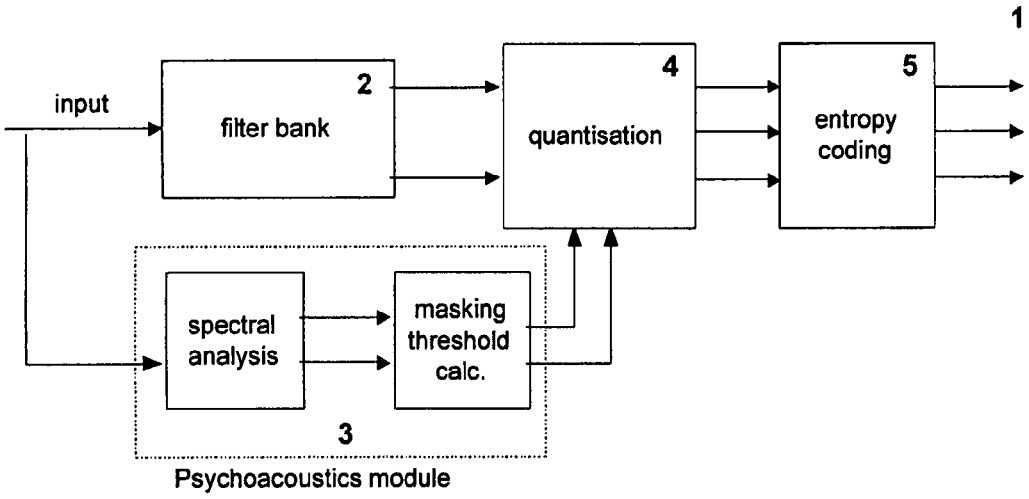
FIG 1 (Prior Art)
FIG. 1 shows a schematic functional block diagram of a typical perceptual encoder.

FIG. 1 shows a schematic functional block diagram of a typical perceptual encoder. The perceptual encoder 1 comprises a filter bank 2 for time to frequency transformation, a psychoacoustics model (PAM) 3, a quantization unit 4, and an entropy unit 5. The filter bank, PAM, and quantization unit are the essential parts of a typical perceptual encoder. The quantization unit uses the masking thresholds from the PAM to decide how best to use the available number of data bits to represent the input audio data stream.

Figure 2:
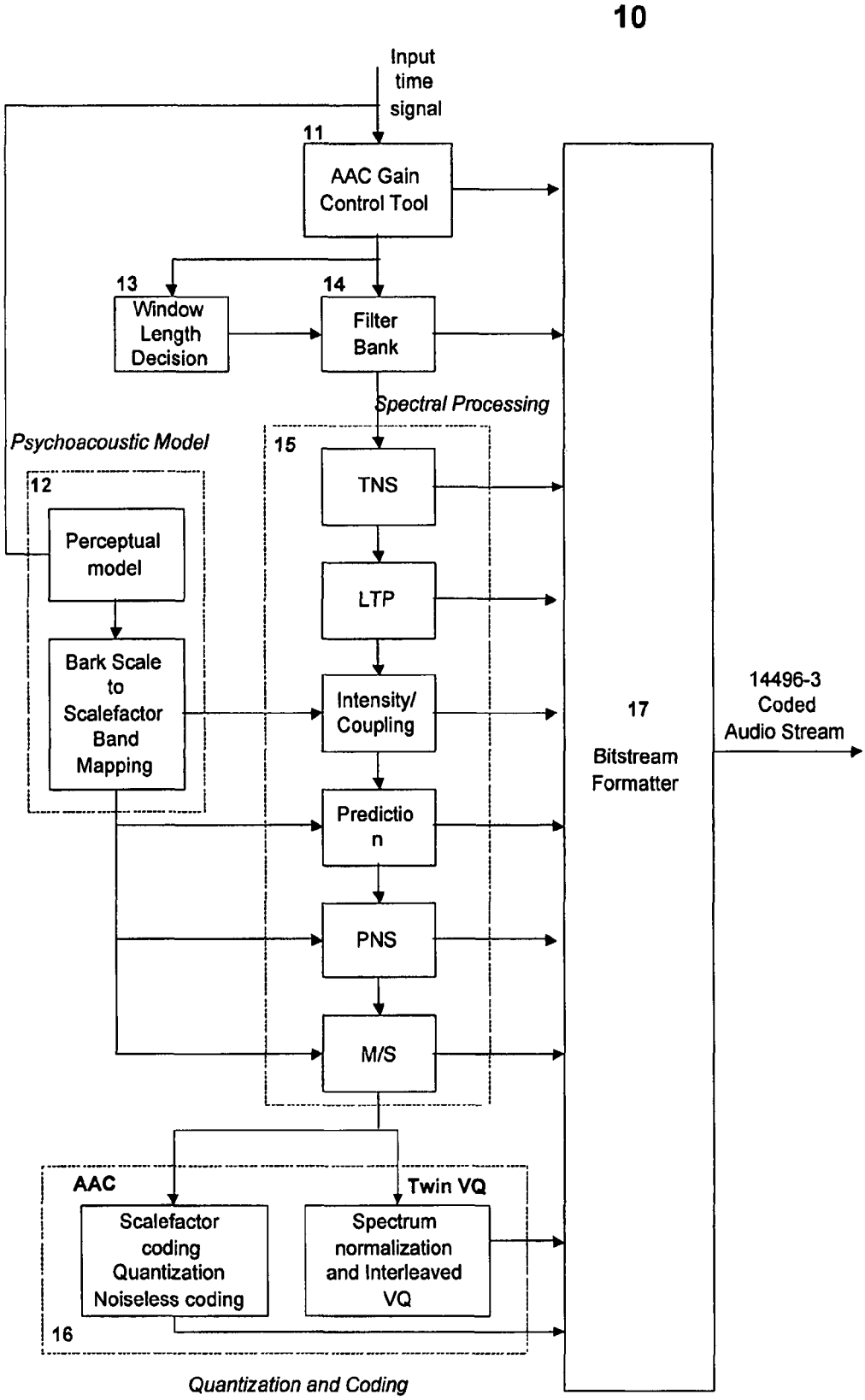
FIG 2 (Prior Art)
FIG. 2 shows a detailed functional block diagram of MPEG4-AAC perceptual coder.

MPEG4 Advanced Audio Coding (AAC) is the current state-of-the-art perceptual audio coder enabling transparent CD quality results at bit rate as low as 64 kbps. See, e.g., ISO/IEC 14496-3, Information Technology-Coding of audio-visual objects, Part 3: Audio (1999). FIG. 2 shows a detailed functional block diagram of an AAC perceptual coder. The AAC perceptual coder 10 comprises an AAC gain control tool module 11, a psychoacoustic model 12, a window length decision module 13, a filter bank module 14, a spectral processing module 15, a quantization and coding module 16, and a bitstream formatter module 17. Noticeably, an extra spectral processing for AAC is performed by the spectral processing module 15 before the quantization. This spectral processing block is used to reduce redundant components, comprising mostly of prediction tools.

AAC uses Modified Discrete Cosine Transform (MDCT) with 50% overlap in its filterbank module. After overlap-add process, due to the time domain aliasing cancellation, it is expected to get a perfect reconstruction of the original signal. However, this is not the case because error is introduced during the quantization process. The idea of a perceptual coder is to hide this quantization error such that our hearing will not notice it. Those spectral components that we would not be able to hear are also eliminated from the coded stream. This irrelevancy reduction exploits the masking properties of human ear. The calculation of masking threshold is among the computationally intensive task of the encoder.

Figure 3:
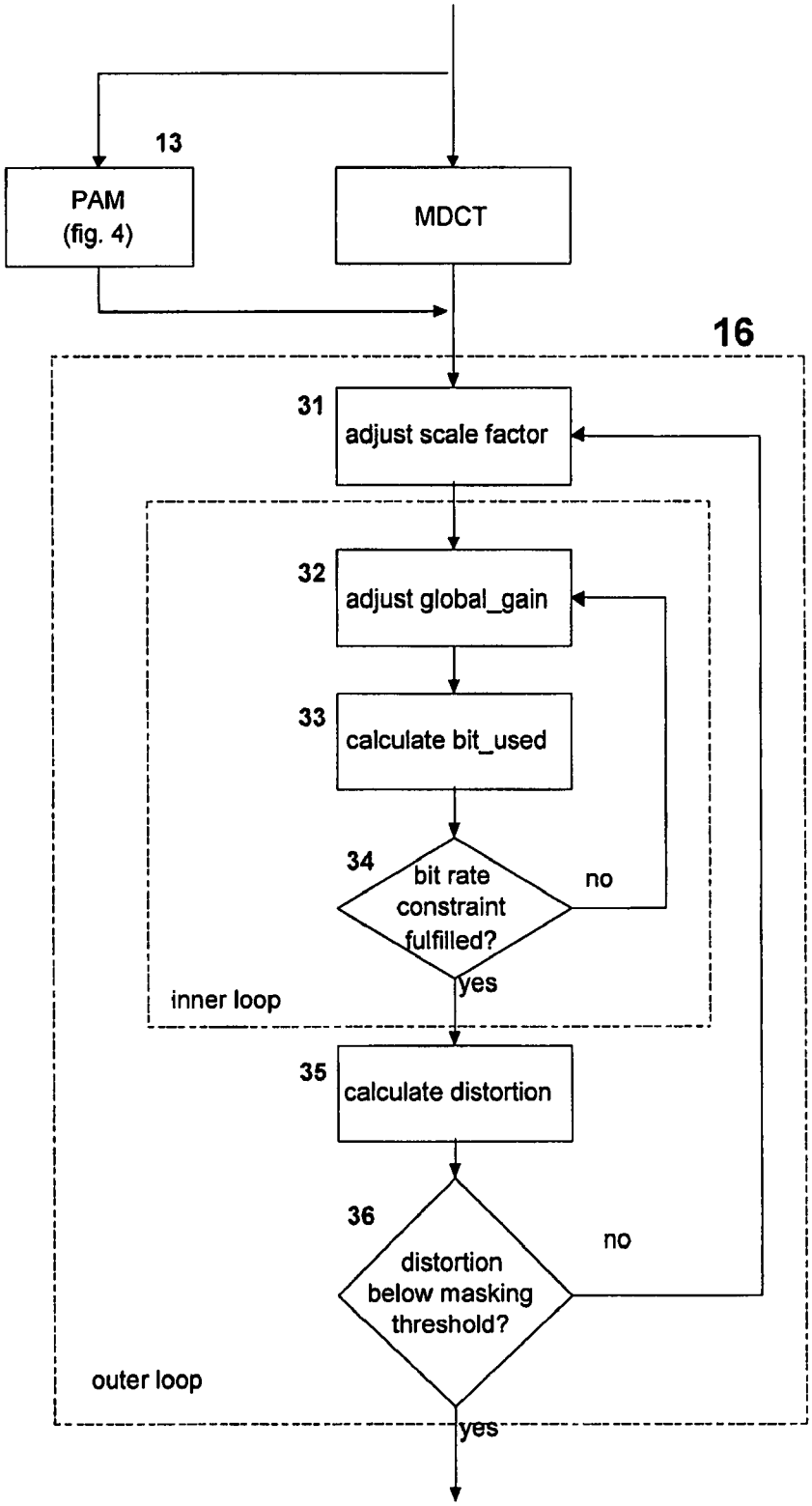
FIG 3 (Prior Art)
FIG. 3 shows conventional encoder structure focusing on PAM and bit allocation module.

As shown in FIG. 3, the AAC quantization module 16 operates in two-nested loops. The inner loop comprises the operations of adjust global gain 32, calculate bit used 33, and determination of whether the bit rate constraint is fulfilled 34. Briefly, the inner loop quantizes the input vector and increases the quantizer step size until the output vector can be coded with the available number of bits. After completion of the inner loop, the out loop checks the distortion of each scale factor band 35 and, if the allowed distortion is exceeded 36, amplifies the scale factor band 31 and calls the inner loop again. AAC uses a non-uniform quantizer.

Figure 4:
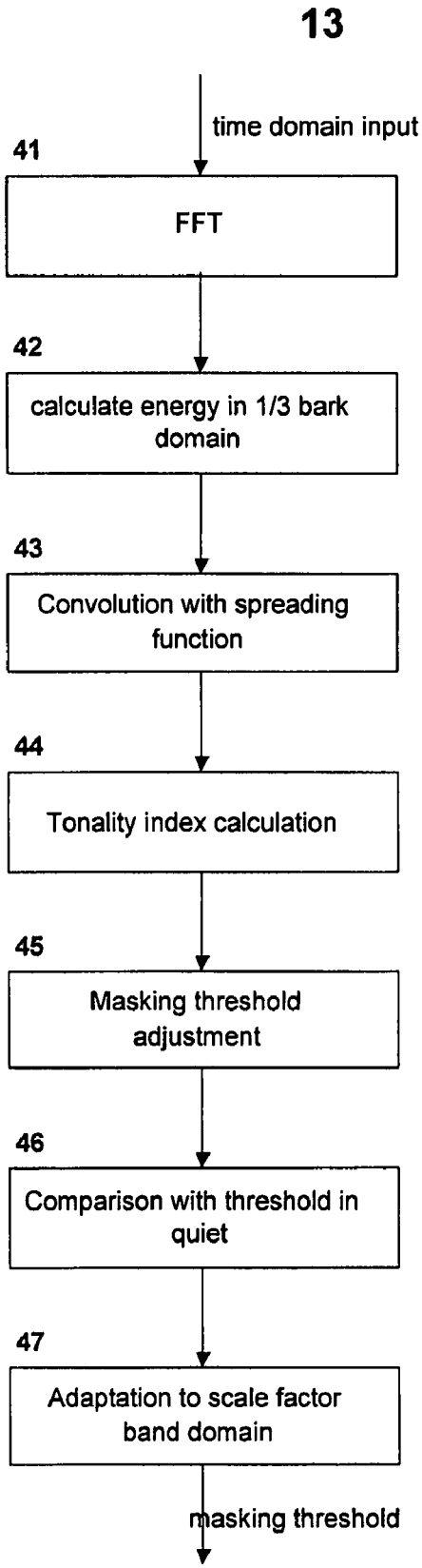
FIG 4 (Prior Art)
FIG. 4 shows conventional estimation of masking threshold.

A high quality perceptual coder has an exhaustive psychoacoustics model (PAM) to calculate the masking threshold, which is an indication of the allowed distortion. As shown in FIG. 4, the PAM calculates the masking threshold by the following steps: FFT of time domain input 41, calculating energy in ⅓ bark domain 42, convolution with spreading function 43, tonality index calculation 44, masking threshold adjustment 45, comparison with threshold in quiet 46, and adaptation to scale factor band domain 47. Due to limited time or computational resource, very often this threshold has to be violated because simply the bits available are not enough to satisfy the masking threshold demand. This poses extra computational weight in the bit allocation module as it iterates through the nested loops trying to fit both distortion and bit rate requirements until the exit condition is reached.

Another feature of AAC is the ability to switch between two different window sizes depending on whether the signal is stationary or transient. This feature combats the pre-echo artifact, which all perceptual encoders are prone to.

It is to be noted that FIG. 2 shows the complete diagram of MPEG4-AAC with 3 profiles defined in the standard including: Main profile (with all the tools enabled demanding substantial processing power); Low Complexity (LC) profile (with lesser compression ratio to save processing and RAM usage); and Scalable Sampling Rate Profile (with ability to adapt to various bandwidths). As processing power savings is our main concern, this disclosure only deals with the LC profile.

It is also to be noted that AAC-LC employs only the Temporal Noise Shaping (TNS) sub-module and stereo coding sub-module without the rest of the prediction tools in the spectral processing module 15 as shown in FIG. 2. Working in tandem with block switching, TNS is also used to reduce the pre-echo artifact by controlling the temporal shape of the quantization noise. However, in LC profile, the order of TNS is limited. The stereo coding is used to control the imaging of coding noise by coding the left and right coefficients as sum and difference.

The AAC standard only ensures that a valid AAC stream is correctly decodable by all AAC decoders. The encoder can accommodate variations in implementation, suited to different resources available and applications areas. AAC-LC is the profile tiled to have lesser computational burden compared to the other profiles. However, the overall efficiency still depends on the detail implementations of the encoder itself. Certain prior attempts to optimize AAC-LC encoder are summarized in Kurniawati, et al., New Implementation Techniques of an Efficient MPEG Advanced Audio Coder, IEEE Transactions on Consumer Electronics, (2004), Vol. 50, pp. 655-665. However, further improvements on the MPEG4-AAC are still desirable to transmit and store audio data with high quality in a low bit rate device running on a low power supply.

Figure 5:
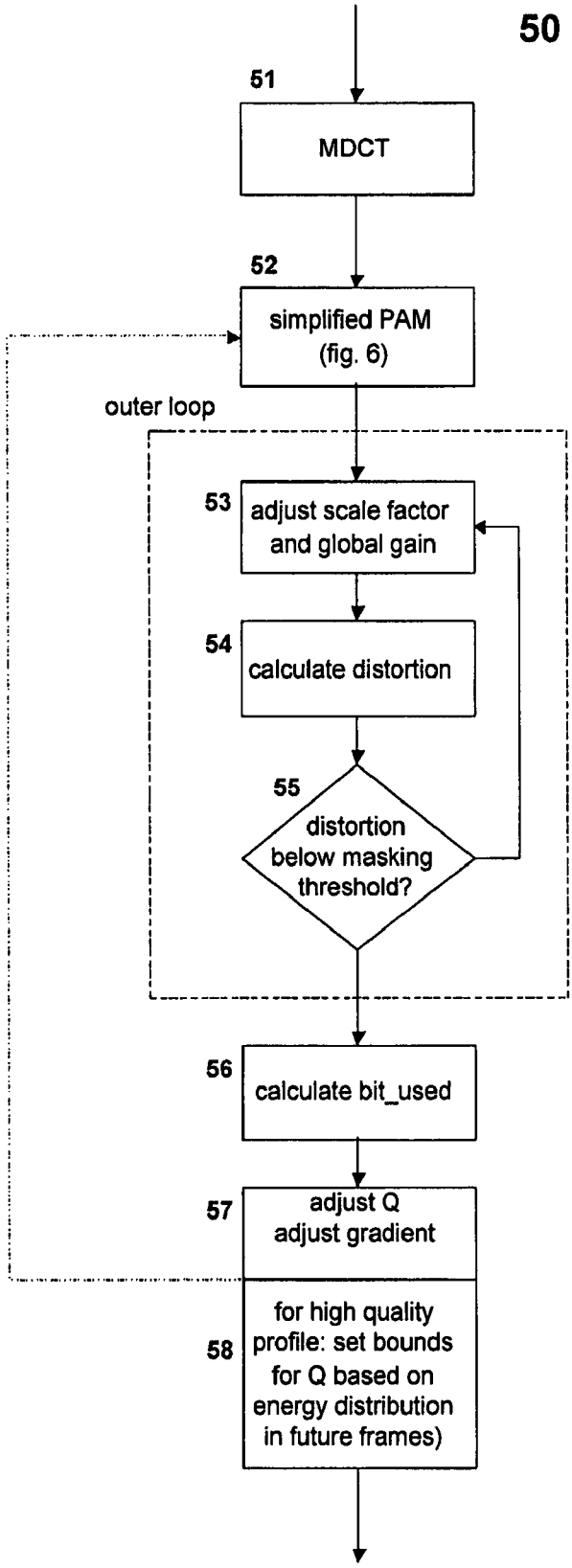
FIG. 5 shows a configuration of the PAM and quantization unit of AAC-LC encoder in accordance with one embodiment of the present disclosure.

The present disclosure provides an audio encoder and audio encoding method for a low power implementation of AAC-LC encoder by exploiting the interworking of psychoacoustics model (PAM) and the quantization unit. Referring to FIG. 5, there is provided a configuration of the PAM and quantization unit of AAC-LC encoder in accordance with one embodiment of the present disclosure. As discussed above, a traditional encoder calculates the masking threshold requirement and feeds it as input to the quantization module; the idea of having a precise estimation of the masking threshold is computationally intensive and making the work of bit allocation module more tasking. The present disclosure aims at coming out with the masking threshold that reflects the bit budget in the current frame, which allows the encoder to skip the rate control loop. In the present disclosure, the bit allocation module has a role in determining the masking threshold for the next frame such that it ensures that the bit used does not exceed the budget. As the signal characteristics changes over time, adaptation is constantly required for this scheme to work. Furthermore, the present disclosure is of reasonably simple structure to minimize the implementation in software and hardware.

Now referring to FIG. 5, the quantization process of the present disclosure comprises a simplified PAM module 52 discussed hereinafter receiving the output of MDCT 51 as input to calculate the masking threshold; a bit allocation process comprising a single loop with adjust scale factor and global gain 53, calculation distortion 54, and determination of whether the distortion is below masking threshold 55; calculating bit used 56; adjust Q adjust gradient 57; and for high quality profile, set bounds for Q based on energy distribution in future frames 58. One of the main differences with the traditional approach as shown in FIG. 3 lies in the bit allocation module, where the present disclosure only uses the distortion control loop instead of the original two-nested loops. Scale factor values are chosen such that they satisfy the masking threshold requirement. The rate control function is absorbed by variable Q, which is adjusted according to the actual number of bits used. This value will be used to fine-tune the masking threshold calculation for the next frame.

Using a variable Q representing the state of the available bits, the encoder attempts to shape the masking threshold to fit the bit budget such that the rate control loop can be omitted. The psychoacoustics model outputs a masking threshold that already incorporates noise, which is projected from the bit rate limitation. The adjustment of Q depends on a gradient relating Q with the actual number of bits used. This gradient is adjusted every frame to reflect the change in signal characteristics. Two separate gradients are maintained for long block and short block and a reset is performed in the event of block switching.

Figure 6:
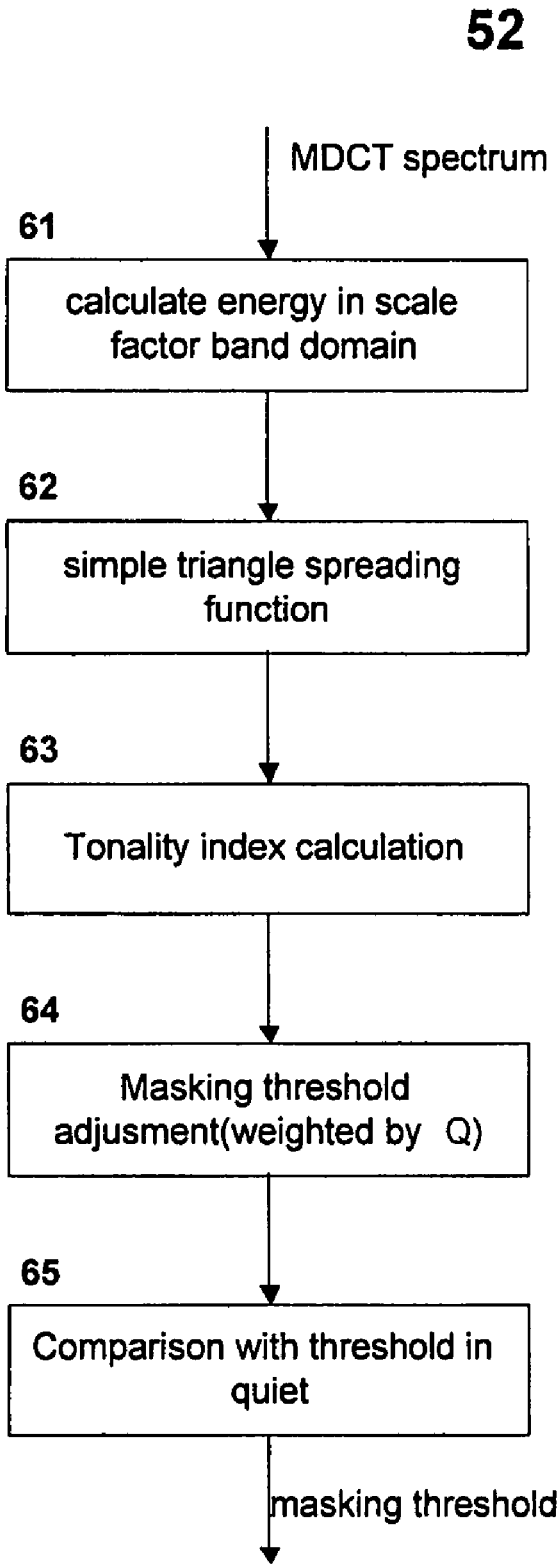
FIG. 6 shows a functional flowchart of the simplified PAM 50 of FIG. 5 for masking threshold estimation in accordance with one embodiment of the present disclosure.

FIG. 6 shows a functional flowchart of the simplified PAM 50 of FIG. 5 for masking threshold estimation in accordance with one embodiment of the present disclosure. The operation of the masking threshold estimation comprises: calculating energy in scale factor band domain 61 using the MDCT spectrum; performing simple triangle spreading function 62; calculating tonality index 63; performing masking threshold adjustment (weighted by Q) 64; and performing comparison with threshold in quiet 65, outputting the masking threshold to the quantization module.

Now there is provided a more detailed description of the operation of the AAC-LC encoder in accordance with one embodiment of the present disclosure. It is to be noted that the present disclosure is an improvement of the existing AAC-LC encoder so that many common features will not be discussed in detail in order not to obscure the present disclosure. The operation of the AAC-LC encoder of the present disclosure comprises: generating MDCT spectrum in the filterbank, estimating masking threshold in the PAM, and performing quantization and coding. The differences between the operation of the AAC-LC encoder of the present disclosure and the one of the standard AAC-LC encoder will be highlighted.

For generating MDCT spectrum, the MDCT used in the Filterbank module of AAC-LC encoder is formulated as follows:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2 \quad \text{(Eqn. 1)}$$

where $X_{i,k}$ is the MDCT coefficient at block index I and spectral index k; z is the windowed input sequence; n the sample index; k the spectral coefficient index; i the block index; and N the window length (2048 for long and 256 for short); and where $n_o$ is computed as (N/2+1)/2.

For estimating the masking threshold, the detailed operation of the simplified PAM of the present disclosure has been described in connection with FIG. 6. The features of the simplified PAM include the followings. First, for efficiency reason, the simplified PAM uses MDCT spectrum for the analysis. Second, the calculation of energy level is performed directly in scale factor band domain. Third, a simple triangle spreading function is used with +25 dB per bark and −10 dB per bark slope. Fourth, the tonality index is computed using Spectral Flatness Measure. Finally, weighted Q as the rate controlling variable is used to adjust the masking threshold. Traditionally, this step reflects the different masking capability of tone and noise. Since noise is a better masker, the masking threshold will be adjusted higher if the tonality value is low, and lower if the tonality value is high. In the present disclosure, besides tonality, Q is also incorporated to fine tune the masking threshold to fit the available bits.

For bit allocation-quantization, AAC uses a non-uniform quantizer:

$$\text{x_quantized}(i) = int\left[\frac{x^{3/4}}{2^{\frac{3}{16}(gl-scf(i))}} + 0.4054\right] \quad \text{(Eqn. 2)}$$

where x_quantized(i) is the quantized spectral values at scale factor band index (i); i is the scale factor band index, x the spectral values within that band to be quantized, gl the global scale factor (the rate controlling parameter), and scf(i) the scale factor value (the distortion controlling parameter).

In the present disclosure, only the scale factor values are searched to control the distortion. The global scale factor value is never adjusted and is taken as the first value of the scale factor (scf(0)).

Figure 10:
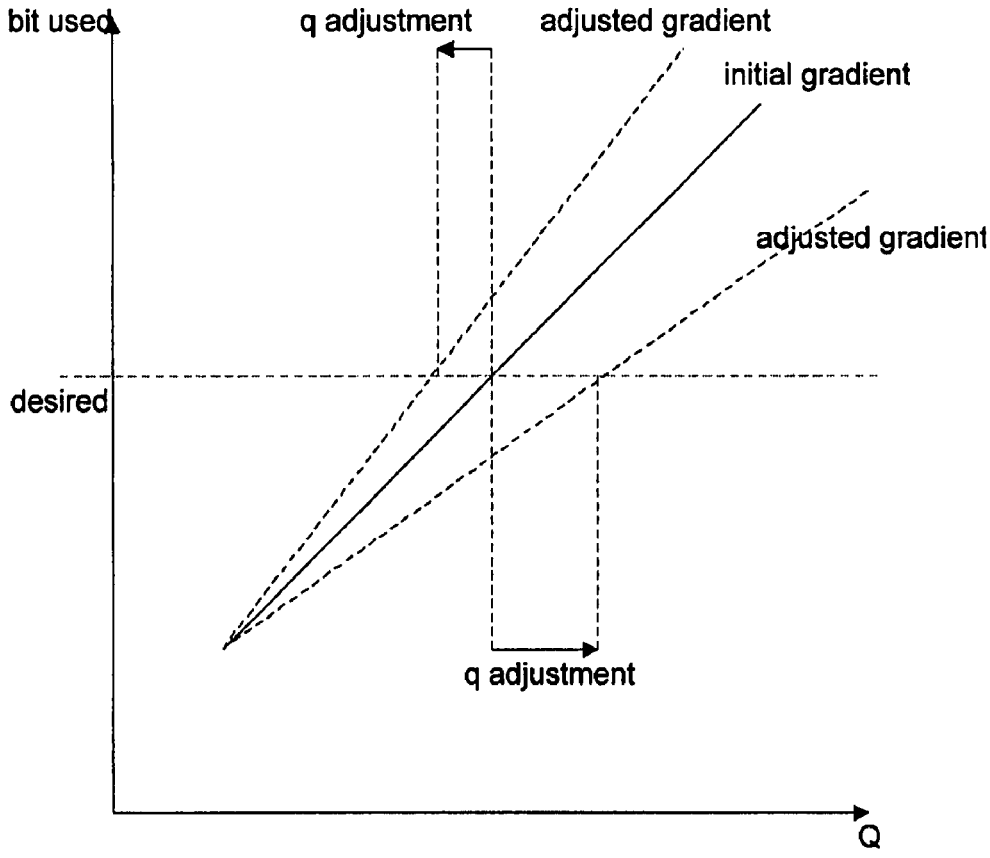
FIG. 10 shows gradient and Q adjustments.

For Q and gradient adjustment, FIG. 10 illustrates these adjustments. Q is linearly adjusted using the following formula:

$$\text{New}Q = Q1 + (R1 - \text{desired_}R)(Q2 - Q1)/(R2 - R1) \quad \text{(Eqn. 3)}$$

where NewQ is basically the variable Q "after" the adjustment; Q1 and Q2 are the Q value for one and two previous frame respectively; and R1 and R2 are the number of bits used in previous and two previous frame, and desired_R is the desired number of bits used; and wherein the value (Q2−Q1)/(R1−R2) is adjusted gradient.

When Q is high, the masking threshold is adjusted such that it is more precise, resulting in an increase in the number of bits used. On the other hand, when the bit budget is low, Q will be reduced such that in the next frame, the masking threshold does not demand excessive number of bits.

Figure 7:
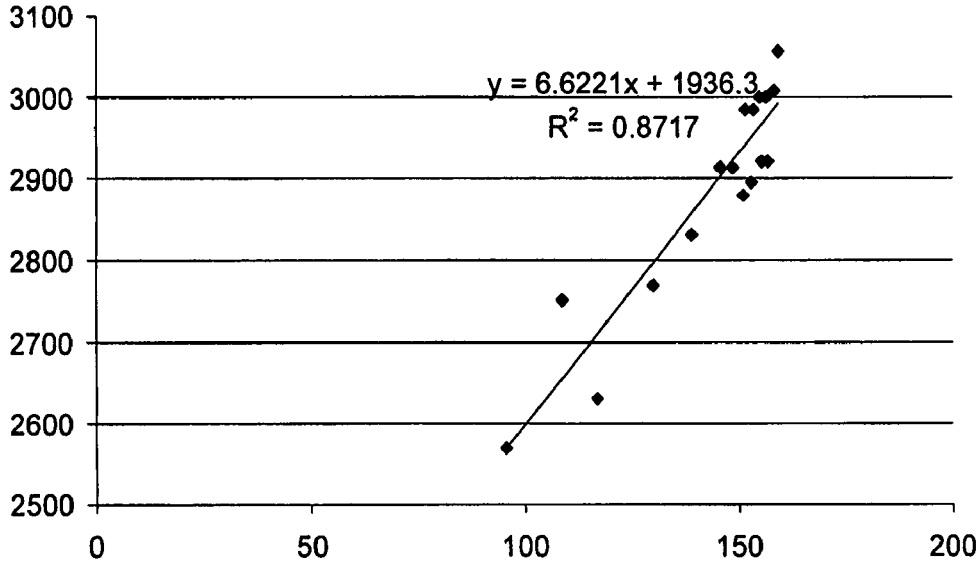
FIG. 7 shows correlation between Q values and number of bits used in long window.
Figure 8:
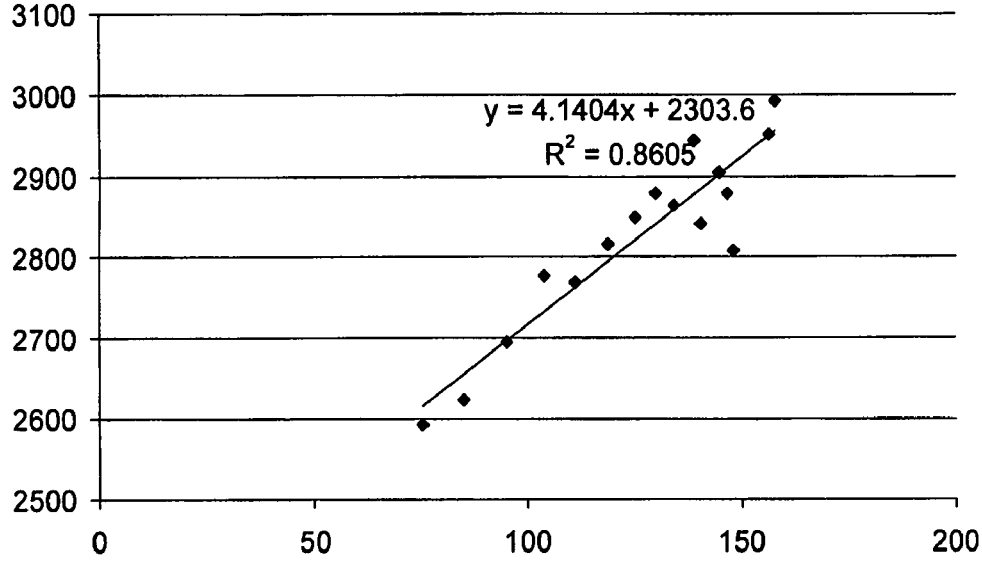
FIG. 8 shows correlation between Q values and number of bits used in long window.
Figure 9:
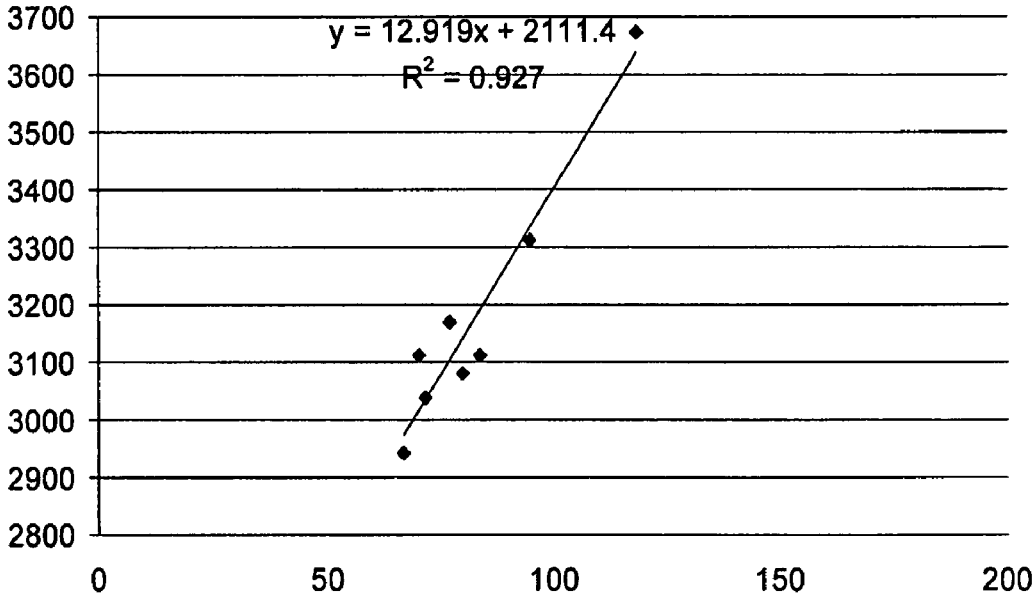
FIG. 9 shows correlation between Q values and number of bits used in short window.

The correlation of Q and bit rate depends on the nature of the signal. FIGS. 7, 8, and 9 illustrate the correlation between these two variables. Different change of Q means different change of bit used for different part of the signal. Therefore, the gradient relating these two variables have to be constantly adjusted. The most prominent example would be the difference between the gradient in long block (FIG. 7 and FIG. 8) and short block (FIG. 9). The disclosure performs a hard reset of this gradient during the block-switching event.

In high quality profile, apart from bit rate, the disclosure also uses the energy distribution across three frames to determine Q adjustment. This is to ensure a lower value of Q is not set for a frame with higher energy content. With this scheme, greater flexibility is achieved and a more optimized bit distribution across frame is obtained.

The present disclosure provides a single loop rate distortion control algorithm based on weighted adjustment of the masking threshold using adaptive variable Q derived from varying gradient computed from actual bits used with the option to distribute bits across frames based on energy.

Figure 11:
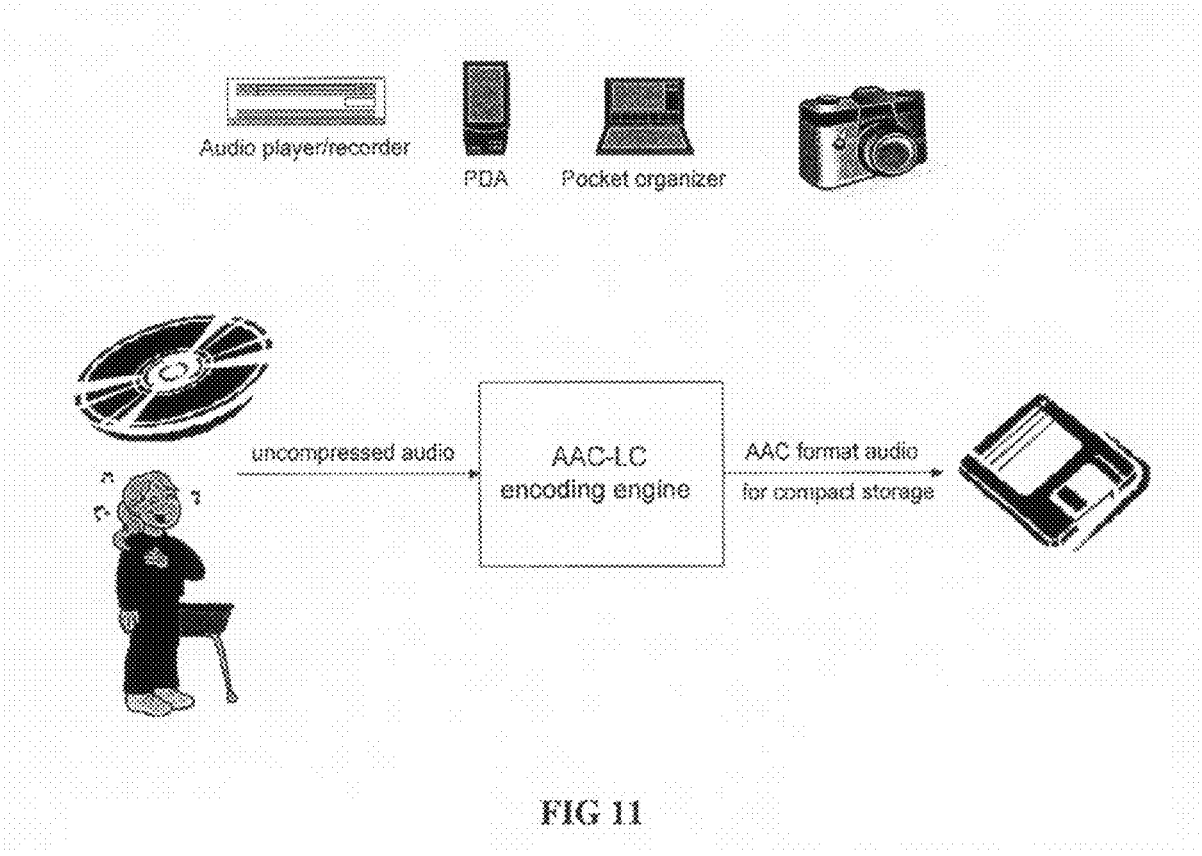
FIG. 11 shows exemplary electronic devices where the present disclosure is applicable.

The AAC-LC encoder of the present disclosure can be employed in any suitable electronic devices for audio signal processing. As shown in FIG. 11, the AAC-LC encoding engine can transform uncompressed audio data into AAC format audio data for transmission and storage. The electronic devices such as audio player/recorder, PDA, pocket organizer, camera with audio recording capacity, computers, and mobile phones comprises a computer readable medium where the AAC-LC algorithm can be embedded.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A process for encoding audio data comprising:

receiving uncompressed audio data from an input;

generating an MDCT spectrum for each frame of the uncompressed audio data using a filterbank;

estimating, using an audio encoder, masking thresholds for a current frame to be encoded based on the MDCT spectrum, wherein the masking thresholds reflect a bit budget used for the current frame;

performing quantization of the current frame based on the masking thresholds;

after quantization of the current frame, updating the bit budget, to be used for a next frame, to estimate masking thresholds of the next frame; and encoding the quantized audio data.

2. The process of claim 1, wherein the step of generating an MDCT spectrum further comprises using the following relationship:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2$$

wherein $X_{i,k}$ is an MDCT coefficient at block index I and spectral index k, z is a windowed input sequence, n is a sample index, k is a spectral coefficient index, i is a block index, and N is a window length equal to 2048 for long and 256 for short, and wherein $n_o$ is computed as (N/2+1)/2.

3. The process of claim 1, wherein the step of estimating masking thresholds further comprises:

calculating energy in a scale factor band domain using the MDCT spectrum;

performing a simple triangle spreading function;

calculating a tonality index;

performing a masking threshold adjustment weighted by a variable Q; and performing a comparison with a masking threshold in quiet thereby outputting the masking threshold for quantization.

4. The process of claim 3, wherein the step of performing quantization further comprises using a non-uniform quantizer according to the following relationship:

$$\text{x_quantized}(j) = int\left[\frac{x^{3/4}}{2^{\frac{3}{16}(gl-scf(i))}} + 0.4054\right]$$

wherein x_quantized(j) is a quantized spectral values at scale factor band index (j); j is a scale factor band index, x is a spectral values within a band to be quantized, gl is a global scale factor, and scf(j) is a scale factor value.

5. The process of claim 4, wherein the step of performing quantization further comprises:

searching only the scale factor values to control distortion; and refraining from adjusting the global scale factor value, wherein the global scale factor value is taken as the first value of the scale factor (scf(0)).

6. The process of claim 3, wherein the step of performing masking threshold adjustment further comprises linearly adjusting variable Q using the following relationship:

$$\text{New}Q = Q1 + (R1 - \text{desired_R})\frac{(Q2 - Q1)}{(R2 - R1)}$$

wherein NewQ is the variable Q after adjustment, Q1 and Q2 are the Q value for one and two previous frames respectively, R1 and R2 are numbers of bits used in previous and two previous frames respectively, and desired_R is a desired number of bits used, and wherein the value (Q2−Q1)/(R2−R1) is an adjusted gradient.

7. The process of claim 6, wherein the step of performing a masking threshold adjustment further comprises continuously updating the adjusted gradient based on audio data characteristics with a hard reset of the adjusted gradient performed in event of block switching.

8. The process of claim 6, wherein the step of performing a masking threshold adjustment further comprises bounding and proportionally distributing the value of the variable Q across three frames according to energy content in the respective frames.

9. The process of claim 6, wherein the step of performing a masking threshold adjustment further comprises weighting adjustment of the masking threshold to reflect a number of bits available for encoding by using the value of Q together with the tonality index.

10. An audio encoder to compress uncompressed audio data, the audio encoder comprising:

a psychoacoustics model (PAM) to estimate masking thresholds for a current frame to be encoded based on a MDCT spectrum, wherein the masking thresholds reflect a bit budget for the current frame; and a quantization module to perform quantization of the current frame based on the masking thresholds, wherein after the quantization of the current frame, a bit budget for a next frame is updated to estimate masking thresholds of the next frame, wherein the PAM and quantization module are electronically configured so that the PAM estimates the masking thresholds by taking into account a bit status updated by the quantization module.

11. The audio encoder of claim 10 further comprising:

a receiver to receive uncompressed audio data from an input; and a filter bank electronically connected to the receiver to generate the MDCT spectrum for each frame of the uncompressed audio data, wherein the filterbank is electronically connected to the PAM so that the MDCT spectrum is outputted to the PAM.

12. The audio encoder of claim 10 further comprising an encoding module for encoding the quantized audio data.

13. The audio encoder of claim 12, wherein the encoding module is an entropy encoding module.

14. The audio encoder of claim 11, wherein the filter bank generates the MDCT spectrum using the following relationship:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le N/2$$

wherein $X_{i,k}$ is an MDCT coefficient at block index I and spectral index k, z is a windowed input sequence, n is a sample index, k is a spectral coefficient index, i is a block index, and N is a window length equal to 2048 for long and 256 for short, and wherein $n_o$ is computed as (N/2+1)/2.

15. The audio encoder of claim 10, wherein the psychoacoustics model (PAM) estimates the masking thresholds by:

calculating energy in a scale factor band domain using the MDCT spectrum;

performing a simple triangle spreading function;

calculating a tonality index;

performing a masking threshold adjustment weighted by a variable Q; and performing a comparison with a masking threshold in quiet, thereby outputting the masking threshold for quantization.

16. The audio encoder of claim 15, wherein the step of performing quantization further comprises performing quantization using a non-uniform quantizer according to the following relationship:

$$\text{x_quantized}(j) = int\left[\frac{x^{3/4}}{2^{\frac{3}{16}(gl-scf(i))}} + 0.4054\right]$$

wherein x_quantized(j) is a quantized spectral values at scale factor band index (j); j is a scale factor band index, x is a spectral values within a band to be quantized, gl is a global scale factor, and scf(j) is a scale factor value.

17. The audio encoder of claim 16, wherein the step of performing quantization further comprises:

searching only scale factor values to control distortion; and refraining from adjusting the global scale factor value, whereby the global scale factor value is taken as the first value of the scale factor (scf(0)).

18. The audio encoder of claim 15, wherein the step of performing a masking threshold adjustment further comprises linearly adjusting the variable Q using the following formula:

$$\text{New}Q = Q1 + (R1 - \text{desired_R})\frac{(Q2 - Q1)}{(R2 - R1)}$$

wherein NewQ is the variable Q after adjustment, Q1 and Q2 are the Q value for one and two previous frames respectively, and R1 and R2 are numbers of bits used in previous and two previous frames respectively, and desired_R is a desired number of bits used, and wherein the value (Q2−Q1)/(R2−R1) is an adjusted gradient.

19. The audio encoder of claim 18, wherein the step of performing a masking threshold adjustment further comprises continuously updating the adjusted gradient based on audio data characteristics with a hard reset of the adjusted gradient performed in event of block switching.

20. The audio encoder of claim 18, wherein the step of performing a masking threshold adjustment further comprises bounding and proportionally distributing the value of the variable Q across three frames according to energy content in the respective frames.

21. The audio encoder of claim 18, wherein the step of performing a masking threshold adjustment further comprises weighting the adjustment of the masking threshold to reflect a number of bits available for encoding by using the value of Q together with the tonality index.

22. An electronic device comprising:

an electronic circuitry configured to receive uncompressed audio data;

a non-transitory computer-readable medium embedded with an audio encoder so that the uncompressed audio data can be compressed for transmission and/or storage purposes; and an electronic circuitry configured to output the compressed audio data to a user of the electronic device;

wherein the audio encoder comprises:

a psychoacoustics model (PAM) to estimate masking thresholds for a current frame to be encoded based on a MDCT spectrum, wherein the masking thresholds reflect a bit budget for the current frame; and a quantization module to perform quantization of the current frame based on the masking thresholds, wherein after the quantization of the current frame, a bit budget for a next frame is updated to estimate masking thresholds of the next frame, wherein the PAM and quantization module are electronically configured so that the PAM estimates the masking thresholds by taking into account a bit status updated by the quantization module.

23. The electronic device of claim 22, wherein the audio encoder further comprises:

a receiver to receive uncompressed audio data from an input; and a filter bank electronically connected to the receiver to generate the MDCT spectrum for each frame of the uncompressed audio data, wherein the filterbank is electronically connected to the PAM so that the MDCT spectrum is outputted to the PAM.

24. The electronic device of claim 22, wherein the audio encoder further comprises an encoding module to encode the quantized audio data.

25. The electronic device of claim 24, wherein the encoding module is an entropy encoding module.

26. The electronic device of claim 23, wherein the filter bank generates the MDCT spectrum using the following relationship:

$$X_{i,k} = 2\sum_{n=0}^{N-1} z_{i,n}\cos\left(\frac{2\pi}{N}(n+n_o)\left(k+\frac{1}{2}\right)\right), \text{ for } 0 \le k \le \frac{N}{2}$$

wherein $X_{i,k}$ is an MDCT coefficient at block index I and spectral index k, z is a windowed input sequence, n is a sample index, k is a spectral coefficient index, i is a block index, and N is a window length equal to 2048 for long and 256 for short, and wherein $n_o$ is computed as (N/2+1)/2.

27. The electronic device of claim 22, wherein the psychoacoustics model (PAM) estimates the masking thresholds by the following operations:

calculating energy in a scale factor band domain using the MDCT spectrum;

performing a simple triangle spreading function;

calculating a tonality index;

performing masking threshold adjustment weighted by a variable Q; and performing comparison with a masking threshold in quiet, thereby outputting the masking threshold for quantization.

28. The electronic device of claim 27, wherein the step of performing quantization further comprises performing quantization using a non-uniform quantizer according to the following relationship:

$$\text{x_quantized}(j) = int\left[\frac{x^{3/4}}{2^{\frac{3}{16}(gl-scf(j))}} + 0.4054\right]$$

wherein x_quantized(j) is a quantized spectral values at scale factor band index (j); j is a scale factor band index, x is a spectral values within a band to be quantized, gl is a global scale factor and scf(j) is a scale factor value.

29. The electronic device of claim 28, wherein the step of performing quantization further comprises:

searching only scale factor values to control distortion; and refraining from adjusting the global scale factor value, whereby the global scale factor value is taken as the first value of the scale factor (scf(0)).

30. The electronic device of claim 27, wherein the step of performing a masking threshold adjustment further comprises linearly adjusting the variable Q using the following formula:

$$\text{New}Q = Q1 + (R1 - \text{desired_R})\frac{(Q2 - Q1)}{(R2 - R1)}$$

wherein NewQ is the variable Q after adjustment, Q1 and Q2 are the Q value for one and two previous frames respectively, R1 and R2 are numbers of bits used in previous and two previous frames respectively, and desired_R is a desired number of bits used, and wherein the value (Q2−Q1)/(R2−R1) is an adjusted gradient.

31. The electronic device of claim 30, wherein the step of performing a masking threshold adjustment further comprises continuously updating the adjusted gradient based on audio data characteristics with a hard reset of the adjusted gradient performed in event of block switching.

32. The electronic device of claim 30, wherein the step of performing a masking threshold adjustment further comprises bounding and proportionally distributing the value of the variable Q across three frames according to energy content in the respective frames.

33. The electronic device of claim 30, wherein the step of performing a masking threshold adjustment further comprises weighting adjustment of the masking threshold to reflect a number of bits available for encoding by using the value of Q together with the tonality index.

34. The electronic device of claim 22, wherein the electronic device is one of an audio player/recorder, a personal digital assistant (PDA), a pocket organizer, a camera with audio recording capacity, a computers, and a mobile phones.

35. A process for encoding audio data comprising:

receiving uncompressed audio data from an input;

generating an MDCT spectrum for each frame of the uncompressed audio data using a filterbank;

estimating, using an audio encoder, masking thresholds for a current frame to be encoded based on the MDCT spectrum for the current frame, wherein the masking thresholds reflect a bit budget for the current frame, wherein estimating the masking thresholds includes:

performing a masking threshold adjustment weighted by a variable Q by linearly adjusting the variable Q using the following relationship:

$$\text{New}Q = Q1 + (R1 - \text{desired_R})\frac{(Q2 - Q1)}{(R2 - R1)}$$

wherein NewQ is the variable Q after adjustment, Q1 and Q2 are the Q value for one and two previous frames respectively, R1 and R2 are numbers of bits used in previous and two previous frames respectively, and desired_R is a desired number of bits used, and wherein the value (Q2−Q1)/(R2−R1) is an adjusted gradient;

performing quantization of the current frame based on the adjusted masking thresholds;

after the quantization of the current frame, updating a bit budget for a next frame to estimate masking thresholds of the next frame; and encoding the quantized audio data.

* * * * *